US006474704B1

(12) United States Patent
Rathmann et al.

(10) Patent No.: US 6,474,704 B1
(45) Date of Patent: Nov. 5, 2002

(54) LOCK FOR A VEHICLE DOOR

(75) Inventors: Klaus Rathmann, Frankfurt; Torsten Wagner, Wiesbaden, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/367,987

(22) PCT Filed: Feb. 17, 1998

(86) PCT No.: PCT/EP98/00900

§ 371 (c)(1),
(2), (4) Date: Nov. 23, 1999

(87) PCT Pub. No.: WO98/37294

PCT Pub. Date: Aug. 27, 1998

(30) Foreign Application Priority Data

Feb. 20, 1997 (DE) ..... 197 06 657

(51) Int. Cl.[7] ..... E05C 3/06
(52) U.S. Cl. ..... 292/201; 292/216; 292/DIG. 23
(58) Field of Search ..... 292/216, 201, 292/DIG. 23, DIG. 43; 74/661, 665 B

(56) References Cited

U.S. PATENT DOCUMENTS

| | | | | |
|---|---|---|---|---|
| 4,102,213 A | | 7/1978 | Smith | |
| 4,875,351 A | | 10/1989 | Evans et al. | |
| 4,986,099 A | | 1/1991 | Johnson et al. | |
| 5,236,234 A | * | 8/1993 | Norman | 292/201 |
| 5,480,198 A | | 1/1996 | Wydler et al. | |
| 5,802,894 A | * | 9/1998 | Jahrsetz et al. | 70/264 |
| 6,003,910 A | * | 12/1999 | Dupont et al. | 292/201 |
| 6,131,967 A | * | 10/2000 | Kondo et al. | 292/201 |

FOREIGN PATENT DOCUMENTS

| | | | |
|---|---|---|---|
| DE | 4218177 | | 12/1993 |
| DE | 4228233 | | 3/1994 |
| DE | 4240013 | | 6/1994 |
| DE | 19501493 | | 7/1996 |
| DE | 19505779 | | 8/1996 |
| DE | 19611972 | | 10/1996 |
| DE | 19547724 | | 6/1997 |
| FR | 2231241 | | 12/1974 |
| JP | 6-288131 | * | 10/1994 |

* cited by examiner

*Primary Examiner*—Teri Pham Luu
(74) *Attorney, Agent, or Firm*—Martin A. Farber

(57) ABSTRACT

Lock for a movable arrangement, such as a door, rear flap or the like of a vehicle, having an actuating drive (10) for the drive of a component, in particular a detent pawl (4), of the lock, wherein, for the direct or indirect drive of the component, a further actuating drive (13) for the component is provided.

8 Claims, 1 Drawing Sheet

LOCK FOR A VEHICLE DOOR

FIELD AND BACKGROUND OF THE INVENTION

The invention relates to a lock for a movable arrangement, such as a door, rear flap or the like of a vehicle, for the drive of a component.

DE 42 28 233 A1 discloses a lock having lock components, such as a rotary latch and detent pawl, in which the detent pawl arrests or releases the rotary latch. The release takes place as a function of instructions issued by an operator, if appropriate via a remote control, by the fact that an actuating drive, which moves the detent pawl, is set in operation, as a result of which the rotary latch is then released, so that the movable arrangement (such as, for example, a door, rear flap or the like opens or can be opened.

This lock actually functions satisfactorily but has the disadvantage that additional devices, by means of which a mechanical connection between a handle and a component of the lock is provided or can be produced in an emergency, are also required for safety reasons. In this connection, said known lock comprises a multiplicity of Bowden cables which transmit an actuation of the handle through the actuating drive or the detent pawl via a lifting mechanism in an emergency. This necessitates a multiplicity of additional components which require a disproportionately high outlay on installation, since the handle is generally arranged at a distance from the lock. The Bowden cables therefore have to be placed in the body of the door, in particular, which not only results in a high outlay on installation but also in high material costs.

SUMMARY OF THE INVENTION

The invention is therefore based on the object of providing a lock which, with the point of view of comfort taken into consideration, satisfies the required safety precaution such a manner that in the event of one actuating drive breaking down, there is always a further way of opening the movable arrangement.

According to the invention, provision is made for the multiplicity of components, which relate to the redundancy (such as Bowden cables, lever mechanism, etc.), from the abovementioned prior art to be replaced by a further actuating drive, which acts directly or indirectly on the component, in particular the detent pawl, of the lock. The direct drive is understood as the fact that whenever the first actuating drive is switched on, at the same time the further actuating drive is also always switched on, so that in the event of one actuating drive breaking down, a further actuating drive is still always available for the opening of the movable arrangement. The direct drive is further understood as the fact that the movement of the actuating drive is transmitted to the component without stepping down or stepping up and without changing the transmission movement. This is the case, for example, in an actuating drive which is designed as a solenoid with an actuating element and in which the linear movement of the actuating element is transmitted directly to the detent pawl.

An indirect drive is understood as the fact that it is normally always the first actuating drive which is actuated to effect an opening procedure, and only in the event of the first actuating drive being defective is the further actuating drive actuable—optionally with a time-delay. The indirect drive is further understood as the fact that the movement of an actuating drive or of both actuating drives is converted (for example from a linear movement into a rotational movement or vice versa) in a stepped-down or stepped-up manner. The freedom of design when configuring the lock as a function of the actuating drive used is thereby increased.

BRIEF DESCRIPTION OF THE DRAWINGS

Further refinements of the invention are specified herein, from which advantageous effects arise, and are also described in the following and explained with reference to the single FIGURE of the drawing.

DETAILED DESCRIPTION OF THE PREFERRED EMBODIMENTS

Figure 1:
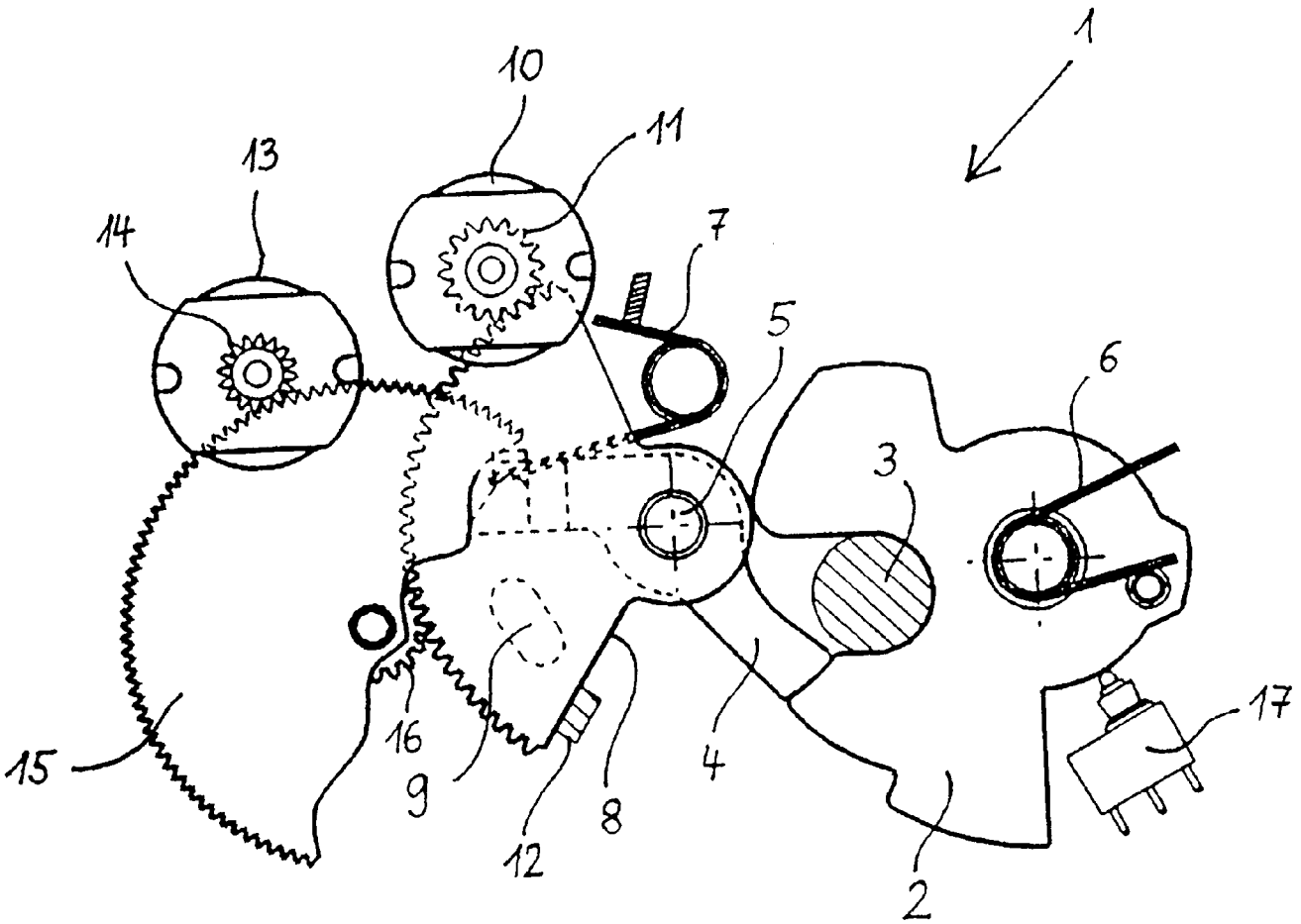

The single FIG. 1 shows a detail from a lock, in which components, such as the remote control, handles having detecting devices for detecting the actuation of the handles, and further elements of the lock are not shown. A detent-pawl drive, which is provided with the reference number 1 in FIG. 1, has a rotary latch 2 which fits around a locking bolt 3, in a manner known per se, as a result of which the movable arrangement is kept in its locked state. In the position shown, the rotary latch 2 is arrested by a detent pawl 4, the detent pawl 4 being movable about a pivot 5. If, when looking at FIG. 1, the detent pawl 4 is partially rotated clockwise about the pivot 5, the rotary latch 2 is released, and so the movable arrangement can be opened. The rotary latch 2 and the detent pawl 4 are in each case pretensioned in the position which is shown in FIG. 1 by a rotary-latch spring 6 and a detent pawl spring 7.

It is shown in FIG. 1 that the detent pawl 4 is driven, which is explained in the following. As an alternative to this, it is also conceivable for the drive to act on the rotary latch 2. Likewise mounted about the pivot 5 (or alternatively about a further pivot) is a toothed-wheel segment 8 which freewheels with respect to the detent pawl 4 and can be brought to bear on the latter. For this purpose, a stop 9 is arranged on the toothed-wheel segment 8, said stop 9 being able to be brought, after a first actuating drive 10 is actuated, into operative connection with the detent pawl 4 in order thereby to release the rotary latch 2. The rotational movement of the actuating drive 10, which is, for example, an electric motor bearing a pinion 11 on its drive shaft, is transmitted to the toothed-wheel segment 8, with the result that the pinion 11, in conjunction with the toothed-wheel segment 8, forms a step-down gear. After the actuating drive 10 is switched on, the toothed-wheel segment 8 rotates in the clockwise direction, as a result of which the detent pawl 4 is entrained and the rotary latch 2 is thereby released. After the actuating drive 10 has been switched off, at least the toothed-wheel segment 8 returns, for example, owing to spring stressing or owing to the rotational direction of the actuating drive 10 being reversed, into its starting position which is defined by a stop 12.

According to the invention, a further actuating drive 13 is provided which is likewise designed as an electric motor and on its drive shaft bears a further pinion 14. In an advantageous manner, the two actuating drives 10 and 13 are designed as constructionally identical electric motors which are of good value and reduce the number of parts.

The pinion 14 meshes with a further toothed wheel segment 15, the toothed-wheel segment 15 bearing a toothed wheel 16 of smaller diameter, said toothed wheel 16 meshing with the toothed-wheel segment 8. In this manner, a gear is arranged both between the first actuating drive 10 and the detent pawl 4 and also between the further actuating drive 13 and the detent pawl 4, the two gears being freewheeling with respect to each other. The two gears, which are designed as step-down gears, are configured in such a manner that the gear between the further actuating drive 13 and the detent pawl 4 has a higher step-down ratio than the gear between the first actuating drive 10 and the detent pawl 4. This has the advantage that the actuating drive 10 produces a small moment (for example between 1 and 5 Nm) with which the detent pawl 4 can be moved within a short time (for example in the time range between 10 and 500 ms) from its arrested position into the release position. The further step-down gear is configured in such a manner that the actuating drive 13 produces a high moment (for example in the range of 10 to 50 Nm) for a longer period of time (for example between 1 and 5 s). This has the advantage that the movable arrangement can normally be opened rapidly by means of the actuating drive 10, i.e. that there is a rapid reaction time when a handle is actuated, while in the event of a defect there is available a powerful actuating drive which applies the necessary forces in order, in the event of a crash, to open a motor vehicle door which has buckled. This varied configuration has the advantage, moreover, that, in the event of the first actuating drive 10 being defective, the uncomfortable and unusually slow opening of the movable arrangement is an indication of there being a defect and of a visit to a garage being required, if appropriate. It is furthermore shown in FIG. 1 that a device is provided for detecting the position of the component or of another component, at least one actuating drive being actuable as a function of the position detected. This device is a rotary-latch switch 17, with other designs for detecting the position of the rotary latch 2 or of the detent pawl 4 or else of the position of the actuating drives or their gears also being possible.

Upon a legitimate opening request by the operator or the driver, the first actuating drive 10 is actuated and the detent pawl 4 releases the rotary latch 2, which is detected by means of the rotary-latch switch 17. In a preferred refinement of the invention, the actuating drive 13 normally remains deactivated, i.e. said actuating drive is not activated. If the actuation of the rotary-latch switch 17 does not happen within a specifiable time span or after a specifiable period of time has elapsed, which means that the door cannot be opened by means of the actuating drive 10, in place of the actuating drive 10 the actuating drive 13 is activated, so that by means of the latter the electromechanical opening of the movable arrangement is initiated. Moreover, the further actuating drive 13 can be switched on directly or with a time delay after recognition of an accident (for example when there is a triggering signal for an airbag). In the event of the power supply of the vehicle breaking down in an accident, an emergency power supply may be provided at least for the actuating drive 13, ideally for both actuating drives 10 and 13.

LIST OF REFERENCE NUMBERS

1. Detent-pawl drive
2. Rotary latch
3. Locking bolt
4. Detent pawl
5. Pivot
6. Rotary-latch spring
7. Detent-pawl spring
8. Toothed-wheel segment
9. Stop
10. First actuating drive
11. Pinion
12. Stop
13. Further actuating drive
14. Pinion
15. Toothed-wheel segment
16. Toothed wheel
17. Rotary-latch switch

What is claimed is:

1. A lock for a movable door or rear flap of a vehicle, having an actuating drive (10), which does not operate manually, for driving a component of the lock, wherein for driving the component, a further actuating drive (13), which likewise does not operate manually, for driving the component is provided; and wherein a gear is arranged between the first actuating drive (10) and the component or between the further actuating drive (13) and the component, and the gears are step-down gears, and the gear between the further actuating drive (13) and the component has a higher step-down ratio than the gear between the first actuating drive (10) and the component.

2. The lock as claimed in claim 1, wherein the two gears are freewheeling with respect to each other.

3. The lock as claimed in claim 1, wherein the two actuating drives (10, 13) are designed as constructionally identical electric motors.

4. The lock as claimed in claim 1, wherein the first actuating drive is actuated to effect an opening procedure, and only in event of the first actuating drive being defective is the further actuating drive actuable.

5. A lock for a movable door or rear flap of a vehicle, having an actuating drive (10), which does not operate manually, for driving a component of the lock, wherein for driving the component, a further actuating drive (13), which likewise does not operate manually, for driving the component is provided, wherein the component is a detent pawl (4) or a rotary latch (2).

6. A lock for a movable door or rear flap of a vehicle, having an actuating drive (10), which does not operate manually, for driving a component of the lock, wherein for driving the component, a further actuating drive (13), which likewise does not operate manually, for driving the component is provided, wherein whenever the first actuating drive is switched on, at the same time the further actuating drive is also always switched on.

7. The lock as claimed in claim 6, wherein the first actuating drive is a solenoid with an actuating element and linear movement of the actuating element is transmitted directly to the detent pawl.

8. A lock for a door of a vehicle, comprising a latch for locking the door, a first electrically motorized drive and a second electrically motorized drive for releasing the latch to unlock the door, wherein the first motorized drive comprises a first electric motor and the second motorized drive comprises a second electric motor, the lock further comprising a gear train interconnecting both of said first and said second motors to a latch release mechanism of the lock, and wherein said gear train provides a relatively fast low-torque driving of the latch release mechanism upon energization of said first motor, said gear train providing a relatively slow high-torque driving of the latch release mechanism upon energization of said second motor; and wherein the gear train has step-down gears, and the step-down gears between the second motorized drive (13) and the release mechanism has a higher step-down ratio than the step-down gears between the first motorized drive (10) and the release mechanism.

* * * * *